US006658825B1

(12) United States Patent
Bliek et al.

(10) Patent No.: US 6,658,825 B1
(45) Date of Patent: Dec. 9, 2003

(54) APPARATUS FOR PACKAGING FIBERS, AND ARTICLE PRODUCED BY SAME

(76) Inventors: David E. Bliek, 1175 Pineville Rd., #86, Chattanooga, TN (US) 37405; Grant Beasley, 41 East Ct., Ringgold, GA (US) 30736

( * ) Notice: Subject to any disclaimer, the term of this patent is extended or adjusted under 35 U.S.C. 154(b) by 0 days.

(21) Appl. No.: 09/551,183

(22) Filed: Apr. 17, 2000

(51) Int. Cl.[7] ..... B65B 63/00

(52) U.S. Cl. ..... 53/522; 53/512; 53/523; 53/529; 53/527

(58) Field of Search ..... 53/512, 522, 523, 53/529, 521, 436, 438, 527, 284.7; 141/114, 10, 71, 73

(56) References Cited

U.S. PATENT DOCUMENTS

| | | | | | |
|---|---|---|---|---|---|
| 3,263,395 | A | * | 8/1966 | Broersma | 53/436 |
| 3,547,577 | A | * | 12/1970 | Lovercheck | 53/436 |
| 3,721,060 | A | * | 3/1973 | Quinto | 53/512 |
| 3,968,620 | A | * | 7/1976 | Keltner | 53/436 |
| 4,004,398 | A | | 1/1977 | Larsson et al. | 53/112 A |
| 4,343,131 | A | * | 8/1982 | McCormick et al. | 53/529 |
| 4,372,101 | A | | 2/1983 | Fleissner | 53/435 |
| 4,706,441 | A | * | 11/1987 | Chervalier | 53/512 |
| 5,074,101 | A | | 12/1991 | Rewitzer | 53/436 |
| 5,144,889 | A | | 9/1992 | Alig et al. | 100/74 |
| 5,363,887 | A | * | 11/1994 | Haeberli | 53/529 |
| 5,459,982 | A | | 10/1995 | Long | 53/529 |
| 5,623,811 | A | | 4/1997 | Hirschek et al. | 53/436 |
| 5,771,665 | A | * | 6/1998 | Nelson et al. | 53/284.7 |
| 5,860,271 | A | * | 1/1999 | Inman et al. | 53/529 |

* cited by examiner

*Primary Examiner*—Eugene Kim
*Assistant Examiner*—Sameh Tawfik
(74) *Attorney, Agent, or Firm*—Jason A. Bernstein; Powell, Goldstein, Frazer & Murphy LLP

(57) ABSTRACT

At least one base plate, at least one fill tube, at least one bag liner tube slidably coupled to the fill tube and capable of receiving a bag thereon, at least one ram that slides within the fill tube, at least one feed tube attached to the fill tube, at least one distribution bin attached to the feed tube, and at least one rotating pin assembly within the distribution bin. With the bag liner tube being inside the bag it may be filled with fibers and the fibers compacted therein without the bag bursting from the resulting forces thereon.

A method of mounting a bag over a slidable bag liner tube, lowering the bag and bag liner tube to a base plate, and compacting fibers therein. An article produced by the method comprising a bag of compacted fibers.

4 Claims, 13 Drawing Sheets

APPARATUS FOR PACKAGING FIBERS, AND ARTICLE PRODUCED BY SAME

FIELD OF THE INVENTION

The present invention relates generally to fiber packaging, and more particularly, to compacting and packaging fibers into a bag for mixing into concrete.

BRIEF DESCRIPTION OF THE PRIOR ART

Synthetic fibers of all types are commonly cut into short and/or random lengths for use as secondary reinforcement in concrete or cement based structures. The fibers are typically packaged in paper bags that can be placed directly into a concrete ready mix truck, a central batch plant, or another mixer for distribution throughout concrete or the like. The combined mixing action of the mixer blades and concrete materials such as cement, sand, water, and/or aggregate contributes to a physical deterioration of the bag. As the bag breaks down the fibers are then distributed by the mixing action into the concrete.

Fiber-reinforced concrete made with these bagged fibers sometimes has problems attributable to inadequate or non-uniform mixing and dispersion of the fibers in the concrete. The bags are typically made of a heavyweight paper such as 30 lb. paper to produce a strong and thick package to hold the fibers contained therein.

Such bulky bags are slow to break down in the mixer because they merely flop around in the mixer until they get wet enough to break down. This prolonged mixing operation wastes time and energy. When the bags have become sufficiently saturated to break down, most of the mixing cycle is completed, thus leaving the fibers undistributed and clumpy. The end result can be a concrete structure with fibers that are not uniformly distributed in all directions, thereby producing a secondary reinforcement system that is ineffective for shrinkage crack control in the concrete.

Several techniques have been and/or are currently being employed for packaging fibers into bags, none of which adequately solves the above-described problems. The simplest technique is a manual bagging operation where individuals place the fibers in plastic bags, weigh the contents, make adjustments to the fiber content until a desired weight is achieved, and heat seal the bag. The plastic bags have to be torn open manually before the contents are placed into the truck or central mixer for dispersion.

An improvement to this manual operation has been developed that utilizes form, fill and seal equipment. This equipment allows for a paper bag to be formed, pre-weighed fibers placed inside the bag, and the bag sealed, all in one continuous operation. This is an automatic system and improves accuracy and productivity. However, even with this improved system, relatively large, thick, and heavy bags are required to hold the volume of fibers typically desired.

Additionally, several techniques are known to have been attempted for packaging fibers into lighter weight bags, none of which has been successful or practical in addressing the above-described problems. Difficulties arise in attempting to package the fibers in a lightweight paper bag that breaks down more quickly in the mixer, while also providing a compact package as is desired for efficient storage and transport, easy handling, automatic batching, and easy distribution into the concrete.

Attempted solutions are known to have included modified bulk handling equipment with blowers, bag dispensers, and other bagging concepts such as multiple bags that are linked together like sausages. These attempts have been unsuccessful or the final product too expensive to be practical in the industry. The major problem with such bulk dispensing equipment is that the synthetic fibers are very difficult to handle. The fibers have a natural tendency to bridge, thus blocking the feed mechanism, clogging up the system, and shutting down the equipment. Furthermore, attempting to compact fibers into lighter weight bags has proved difficult because the lightweight bags tend to burst during the packaging process.

An example of known bulk handling equipment is provided by U.S. Pat. No. 5,074,101 to Rewitzer, which discloses a process and apparatus for packaging and pressing loose fibers comprising a fill shaft with distributing and clearing means such as a pivotal trunk, flap, or paddle and screw conveyors. The fill shaft is connected to a rectangular press container having box bag lined therewithin for holding the loose fibers which are then compressed by a press ram. Another known bulk handling system is provided by U.S. Pat. No. 5,623,811 to Hirschek et al., which discloses a process and device for packaging and supplying fiber material comprising a container for fiber material, a hopper and fill device connected to the container, and a press ram for compacting the fiber therein. Neither Rewitzer nor Hirschek et al. provide for compacting fibers into a lightweight bag to overcome the aforementioned problems.

There is also known the device of U.S. Pat. No. 4,004,398 to Larsson et al., which discloses equipment for packaging pulverized material such a coffee in a flexible film container made of foil or plastic. The equipment comprises a firm container around which the film is formed into the flexible container. A table supports the containers and is raised and lowered. A piston moves up and down in the firm container for compacting the material. Larsson et al. does not provide a device suitable for bulk packaging of fibers in lightweight paper bags.

Accordingly, what is needed but not found in the prior art is an apparatus and method for packaging fibers in a bag in which the fibers are handled without clumping and clogging the handling equipment and the fibers are compacted into the bag without bursting the bag, and the bagged fiber article produced thereby in which the bag is capable of breaking down quickly and easily in the mixer to produce a uniform distribution of the fibers in the concrete.

SUMMARY OF THE INVENTION

Generally described, the present invention provides an apparatus for packaging fibers in a bag, comprising at least one base plate and at least one fill tube having a lower section, a middle section, and an upper section. The lower section of the fill tube has a bottom spaced apart from the base plate so that the bag may be placed between the bottom of the lower section and the base plate.

At least one bag liner tube is slidably coupled to the lower section so that the bag liner tube may slide between an up position and a down position. The up position provides the bag liner spaced apart from the base plate so that the bag may be placed between the bag liner and the base plate. The down position provides the bag liner generally adjacent to the base plate.

At least one ram slides within the fill tube between an up position within the upper section and a down position within the middle and lower sections. At least one feed tube is attached to the middle section, and at least one distribution bin is attached to the feed tube. At least one rotating pin assembly may be provided in the distribution bin, and an electric control may be provided for the rotating pin assembly wherein loose fibers may be advanced through the distribution bin at a uniform rate.

The bag is positioned over the bag liner tube so that the bag liner tube absorbs the sidewall forces and the base plate absorbs the bottom wall forces resulting from compacting the fibers therein. The bag itself is therefore not subjected to these temporary maximum forces so that the fibers can be compacted therein without the bag bursting.

The method of the present invention generally comprises the acts of mounting a bag over a bag liner tube that is in an up position relative to a lower section of a fill tube, sliding the bag liner tube to a down position such that the bag liner tube is adjacent a base plate, advancing a predetermined volume of loose fibers into a middle section and a lower section of the fill tube while a ram is in an up position within an upper section of the fill tube, sliding a ram to a down position in the bag liner tube and bag wherein the loose fibers are compacted into the bag liner tube and bag, sliding the bag liner tube to the up position relative to the lower section of the fill tube, sliding the ram to the up position within the upper section of a fill tube removing the bag from the bag inner tube, and sealing the compacted fibers in the bag.

The act of advancing the loose fibers may comprise rotating pins in a distribution bin attached to a feed tube attached to the middle section of the fill tube. The acts may be repeated as desired for mass production of bags of compacted fibers. The present invention also provides an article produced by the above-described method, comprising a bag of compacted fibers.

The objects, features, and advantages of the present invention are further discussed and/or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENTS

Figure 1:
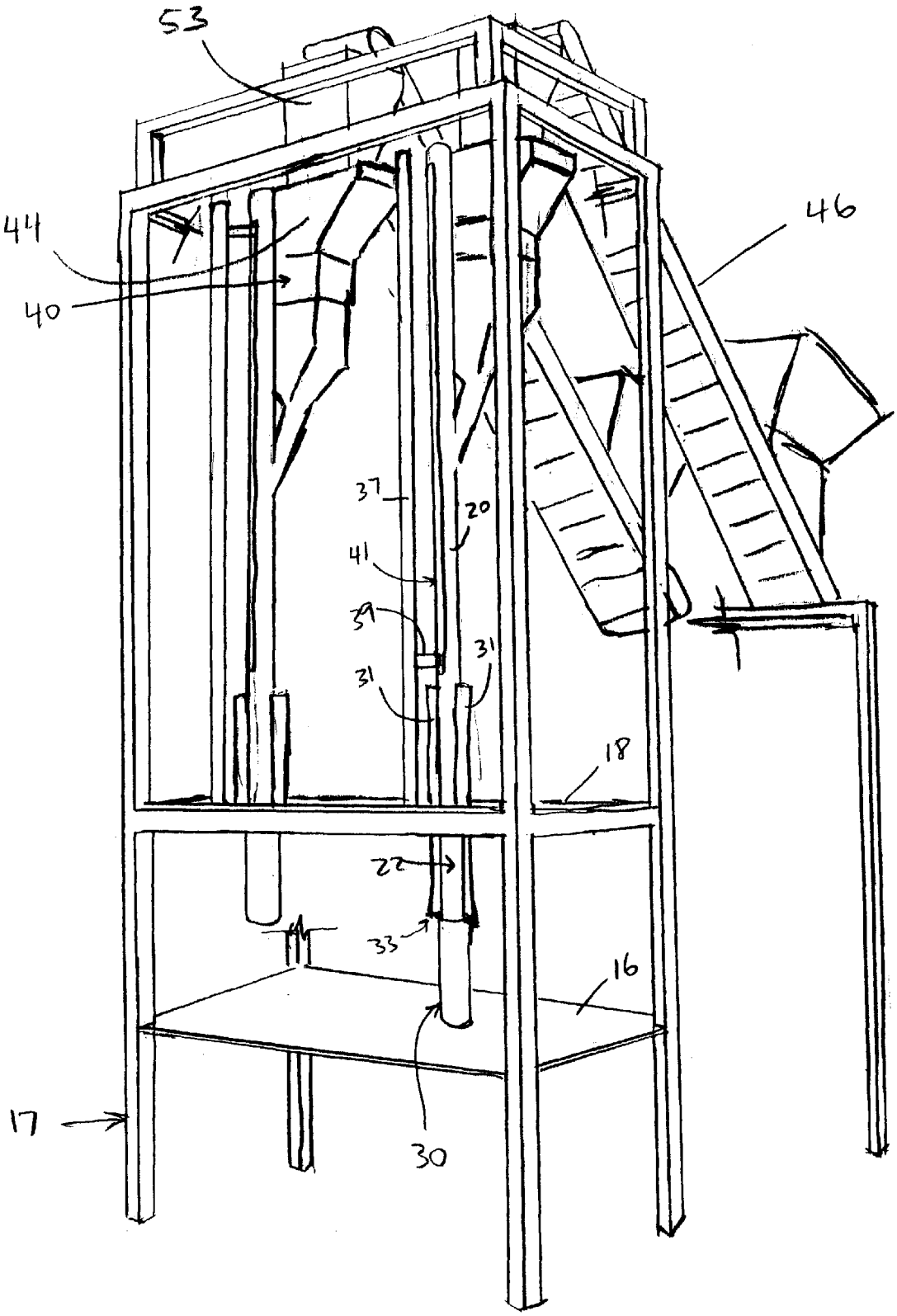
FIG. 1 is a perspective view of one embodiment of the apparatus of the present invention.
Figure 2:
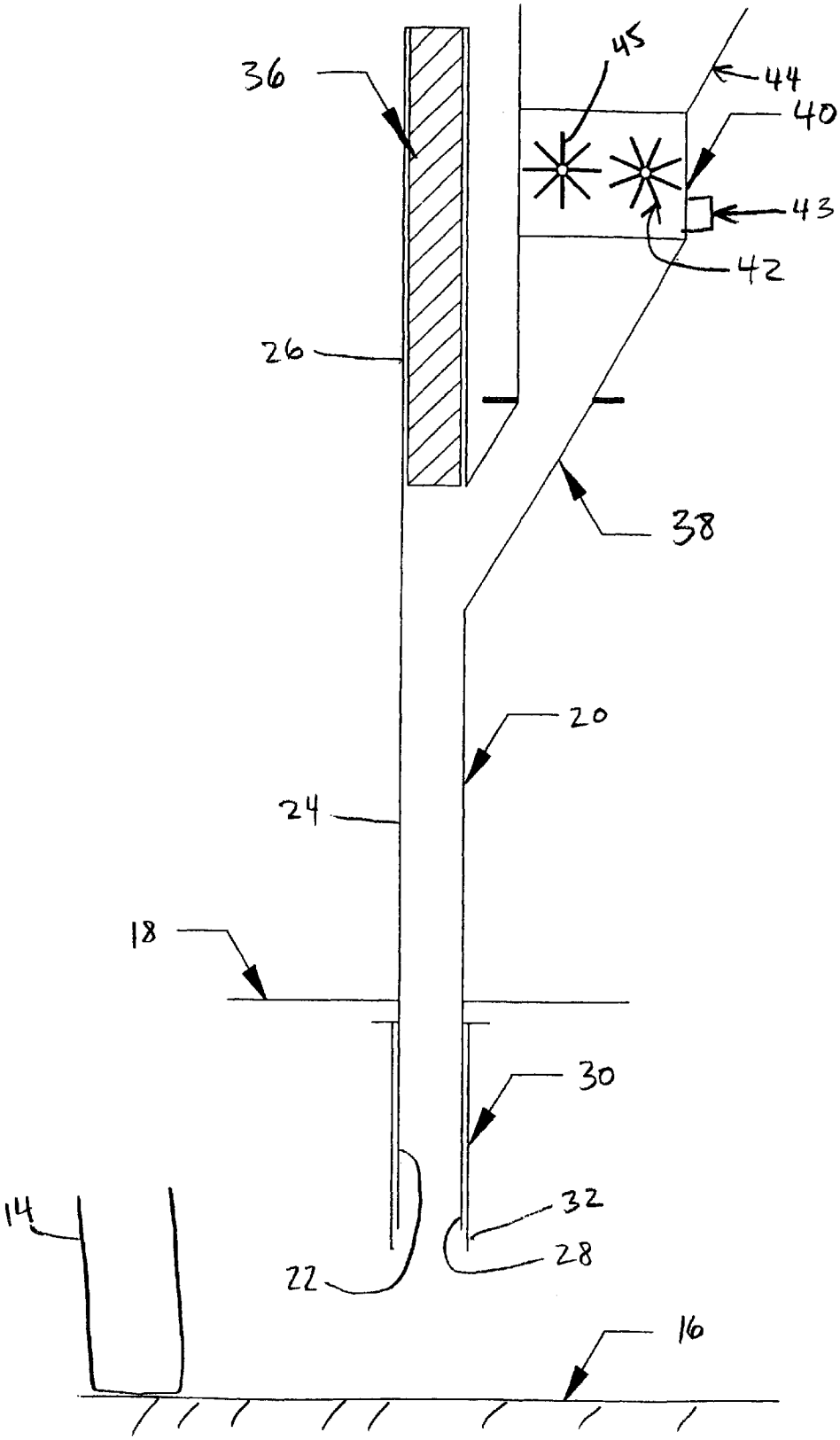
FIG. 2 is an elevation view of one embodiment of the apparatus of the present invention.

Referring now to FIGS. 1 and 2, there is illustrated one of many embodiments of the apparatus, referred to generally as 10, of the present invention for packaging fibers 12 in a bag 14. The apparatus 10 may be used for packaging fibers 12 such as threads, strands, strips, wires, particle matter, interstitial materials, composites, or other fibrous materials made of polypropylene, nylon, polyethylene, polyester, carbon, composites, or other synthetic or organic materials. The bag 14 used with the apparatus 10 may be made of a thin, lightweight material such as 20 lb. weight paper or the like. The material of the bag 14 is selected to be sufficiently strong to contain therein the fibers 12 in a compacted state during shipping and handling, yet sufficiently thin and lightweight to burst and deteriorate quickly when agitated by a mixer blade. The material of the bag 14 does not, however, need to be sufficiently strong to withstand the maximum forces temporarily exerted on the bag 14 during compacting and packaging of the fibers 12 therein with the typical packaging equipment described hereinabove. It should be noted that the apparatus 10 may be provided with a plurality of the below-described elements, however, the apparatus 10 and elements thereof are generally described herein in the singular for simplicity of explanation. For example, two apparatus 10 may be provided in a station operated by one person, so the operator can remove and seal the bag from one apparatus 10 while another apparatus 10 is in the midst of the weighing, feeding, and filling processes.

The apparatus 10 has at least one base plate 16 which may be provided by a floor or by a plate raised off the floor such as mounted on a frame 17, and made of metal, wood, plastic, a composite, or another material, or by another base plate structure known to those skilled in the art. A frame 18 is provided spaced apart from the base plate 16, and may be made of metal, wood, plastic, a composite, or another material. The frame 18 and base plate may be provided as separate components attached or unattached to each other, or may be integrally formed as a single structure.

At least one fill tube 20 is provided having a lower section 22, a middle section 24, and an upper section 26. The fill tube 20 may be made of metal, plastic, wood, ceramic, a composite, or another material known to those skilled in the art. The fill tube 20 may be generally vertical to allow the fibers 12 to flow downward under the force of gravity or may be generally horizontal where a blower or the like is used. The fill tube 20 may have a cross sectional shape that is generally circular, rectangular, polygonal, or another regular or irregular shape.

The lower section 22 of the feed tube 20 has a length such that a bottom 28 thereof is spaced apart from the base plate 18 and spaced apart from the frame 18. At least one bag liner tube 30 is slidably coupled to the lower section 22. The bag liner tube 30 is preferably disposed over, but may alternatively be disposed within, the feed tube lower section 22, and may or may not be in direct contact with the feed tube 20. The bag liner tube 30 may be made of metal, plastic, wood, ceramic, a composite, or another material known to those skilled in the art. The bag liner tube 30 may have a cross sectional shape that is generally circular, rectangular, polygonal, or other regular or irregular shape. The bag liner tube 30 has a cross sectional area that is substantially the same as or slightly less than a cross sectional area of the bag 14 to allow the bag liner tube 30 to be received by the bag 14. Where the bag liner tube 30 is disposed over the feed tube 20, the cross sectional area of the bag liner tube 30 is substantially the same as or slightly larger than the cross sectional area of the lower section 22 of the fill tube 20 to allow the bag liner tube 30 to slide on the lower section 22. Also, the bag liner tube 30 has a length that is the substantially the same as or greater than the length of the bag 14.

The bag liner tube 30 slides between an up position and a down position relative to the feed tube lower section 22. The up position provides a bottom 32 of the bag liner tube 30 spaced apart from the base plate 16 and the down position provides the bag liner tube bottom 32 generally adjacent to the base plate 16. The spacing of the frame 18 from the base plate 16, and the spacing of the fill tube lower section bottom 28 from the frame 18 and from the base plate 16, are selected so that when the bag liner tube 30 is in the up position the bag 14 may be disposed generally between the bag liner tube bottom 32 and the base plate 16, and when the bag liner tube 30 is in the down position the bag liner tube bottom 32 is generally adjacent to the base plate 16.

The bag 14 is positioned over the bag liner tube 30 so that the bag liner tube 30 absorbs the sidewall forces and the base plate 16 absorbs the bottom wall forces resulting from compacting the fibers 12 therein. The bag 14 itself is therefore not subjected to these temporary maximum forces so that the fibers 12 can be compacted therein without the bag 14 bursting.

When the bag liner tube 30 is in the down position, a portion 34 of the bag liner tube 30 extends from the fill tube lower section bottom 28 approximately to the base plate 16. The middle section 24 of the fill tube 20 has a length such that the combined length of the lower section 22, the middle section 24, and the extended portion 34 of the bag liner tube 30 when the bag liner tube 30 is in the down position may hold therein a predetermined volume of loose fibers 12. The length, cross sectional area, and volume capacity of the bag 14 are selected to hold a predetermined volume of compacted fibers 12. For a given length of the bag 14 (based on the desired volume of compacted fibers 12), a desired density/compactness of the packaged fibers 12 (based on the strength properties of the material of the bag 14), and a the readily measurable density/compactness of the loose fibers 12, a compaction ratio may be determined. The compaction ratio of the loose to compacted fibers 12 is a factor in determining the volume of loose fibers 12 to be compacted per bag 14 and the length of the middle section 24, the lower section 22, and the bag liner tube extended-portion 34. For example, for a compaction ratio of 10:1, the combined length of the middle section 24, the lower section 22, and the bag liner tube extended portion 34 is ten times the length of the bag 14. The compacting is thus able to be accomplished in a single compacting step instead of multiple steps of filling and compacting fibers 12 into the bag 14. It should be noted that the fill tube 20 and/or the bag liner tube 30 may be provided with movable sidewalls whereby the fibers 12 may also be compacted from the sides.

Figure 3:
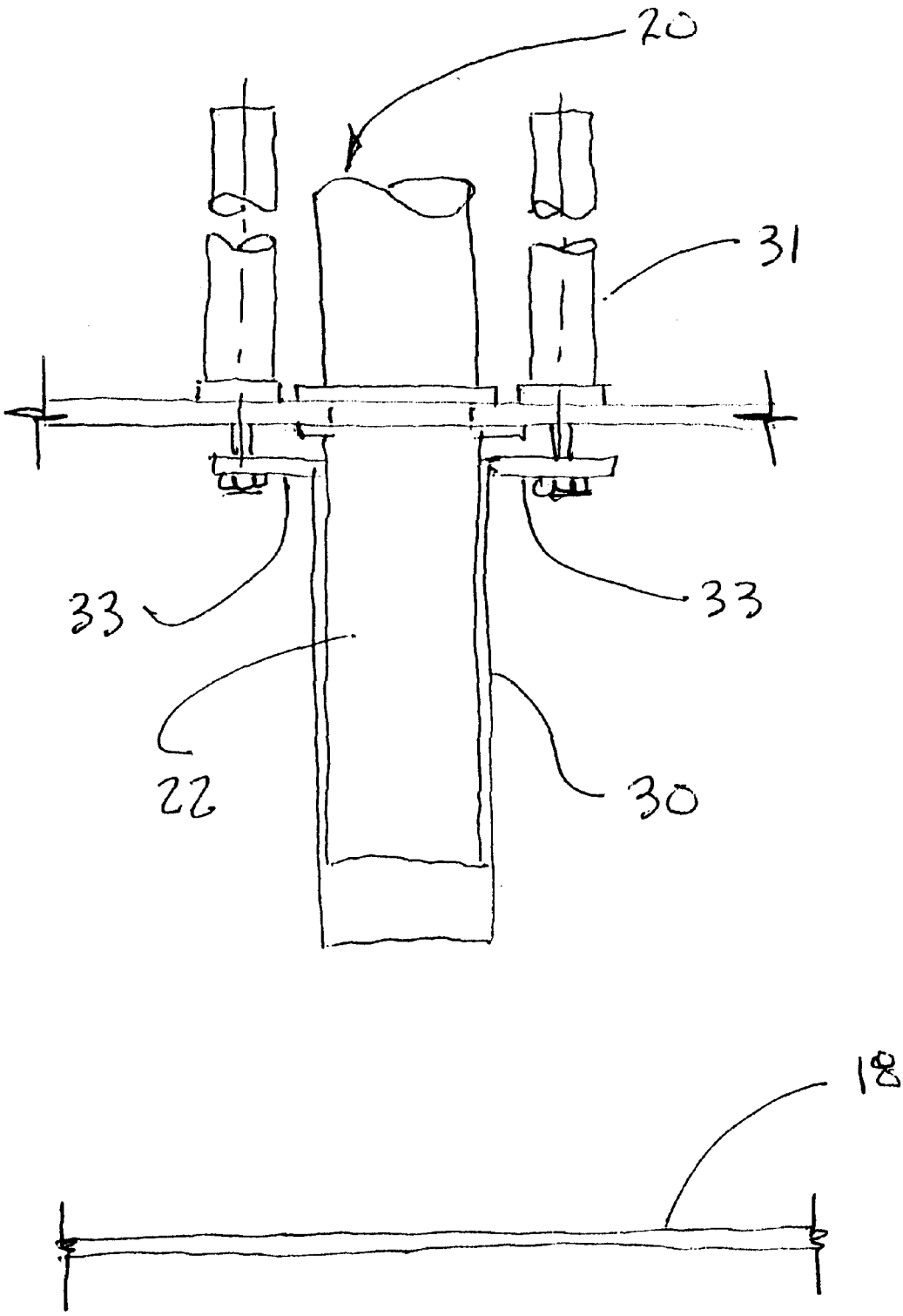
FIG. 3 is a detail view of a portion of FIG. 2.

Referring to FIG. 3, the sliding of the bag liner tube 30 on the fill tube lower section 22 between the up and down positions may be accomplished by incorporating a control system having at least one and preferably two hydraulic or pneumatic cylinders 31 operatively coupled to the bag liner tube 30, for example, by at least one and preferably two brackets 33 extending from exterior walls of the bag liner tube 30, or by another control system known to those skilled in the art. Also, the bag 14 is preferably attached to the bag liner tube 30 by a snug friction fit with the bag 14 circumference or perimeter slightly greater than that of the bag liner tube 30, or may alternatively be attached by providing tabs or a flange extending from the top of the bag liner tube 30 over which the bag 14 may be folded or otherwise attached.

At least one ram 36 is slidably disposed within the fill tube 20 such that the ram 36 may slide between an up position within the upper section 26 and a down position within the middle and lower sections 22 and 24. The ram 36 may be provided by an elongated member, a flat plate, a platen, or another compacting structure known to those skilled in the art, and may be made of metal, plastic, wood, ceramic, a composite, or another material known to those skilled in the art.

Figure 4:
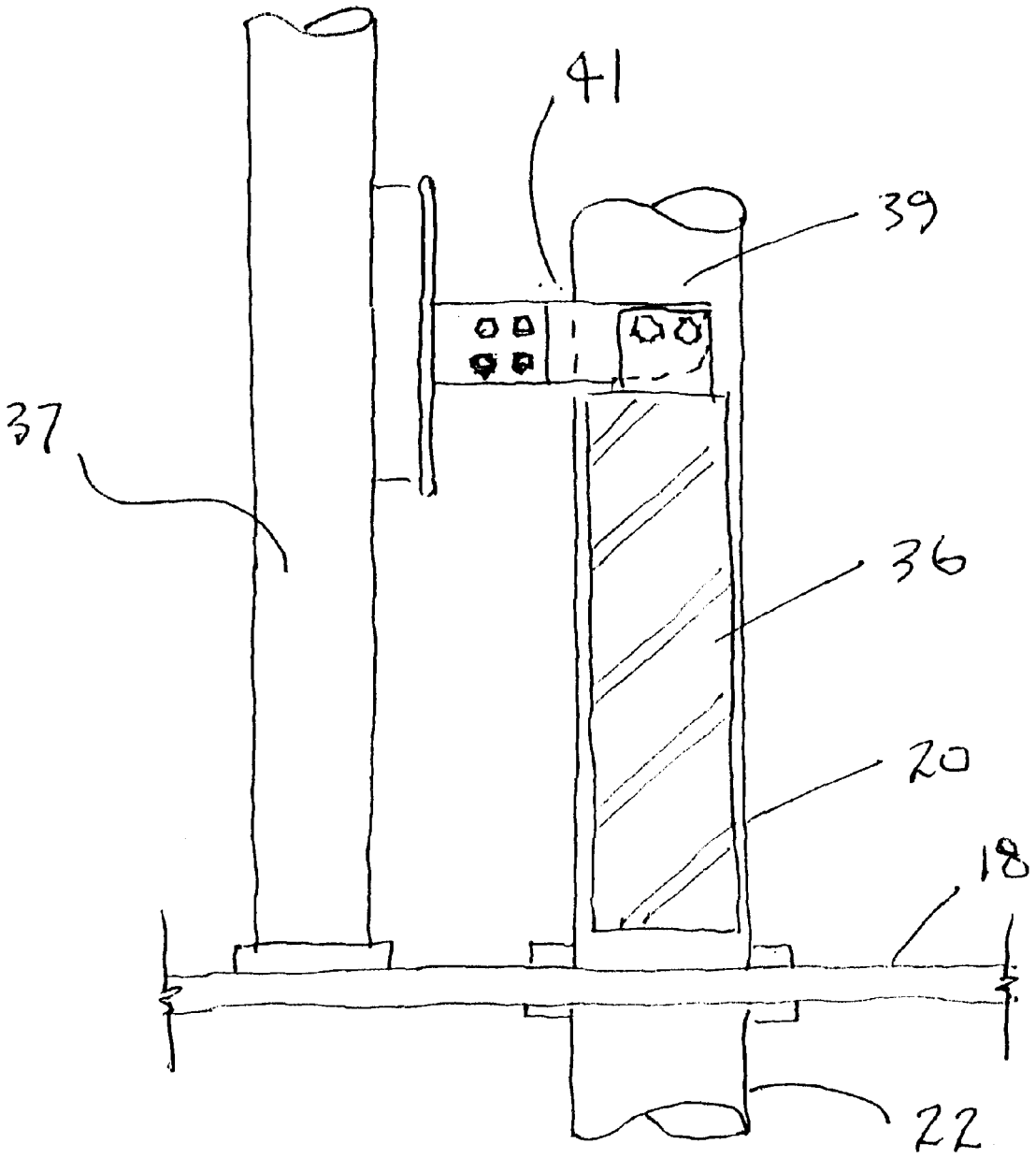
FIG. 4 is a detail view of a portion of FIG. 2.

Referring to FIG. 4, the sliding of the ram 36 within the fill tube 20 between the up and down positions may be accomplished by incorporating a control system having at least one hydraulic or pneumatic cylinder 37 operatively coupled to the ram 36, or by another control system known to those skilled in the art. For example, at least one bracket assembly 39 may interconnect the ram 36 and the cylinder 37 and extend through at least one slot 41 defined in the fill tube 20. Alternatively, the cylinder 37 may be provided within the fill tube upper section 26 above and directly coupled to the ram 36, although this arrangement provides an increased height of the apparatus 10 and may be less suitable in some applications. The cylinder 37 may be provided by, for example, a rod-less air cylinder such as Part No. 50-2021/25X2085 made by the Origa Corporation of Elmhurst, Ill., or by other cylinders known in the art.

At least one feed tube 38 is attached to the middle section 24 of the fill tube 20 for feeding fibers 12 thereto. The feed tube 38 may be made of metal, plastic, wood, ceramic, a composite, or another material known to those skilled in the art. The feed tube 38 may be arranged at an acute angle with respect to the fill tube upper section 26 to allow the fibers 12 to flow therethrough into the fill tube 20 under the force of gravity or the feed tube 38 may be generally horizontal where a blower or the like is used. The feed tube 38 may have a cross sectional shape that is generally circular, rectangular, polygonal, or another regular or irregular shape.

Figure 5:
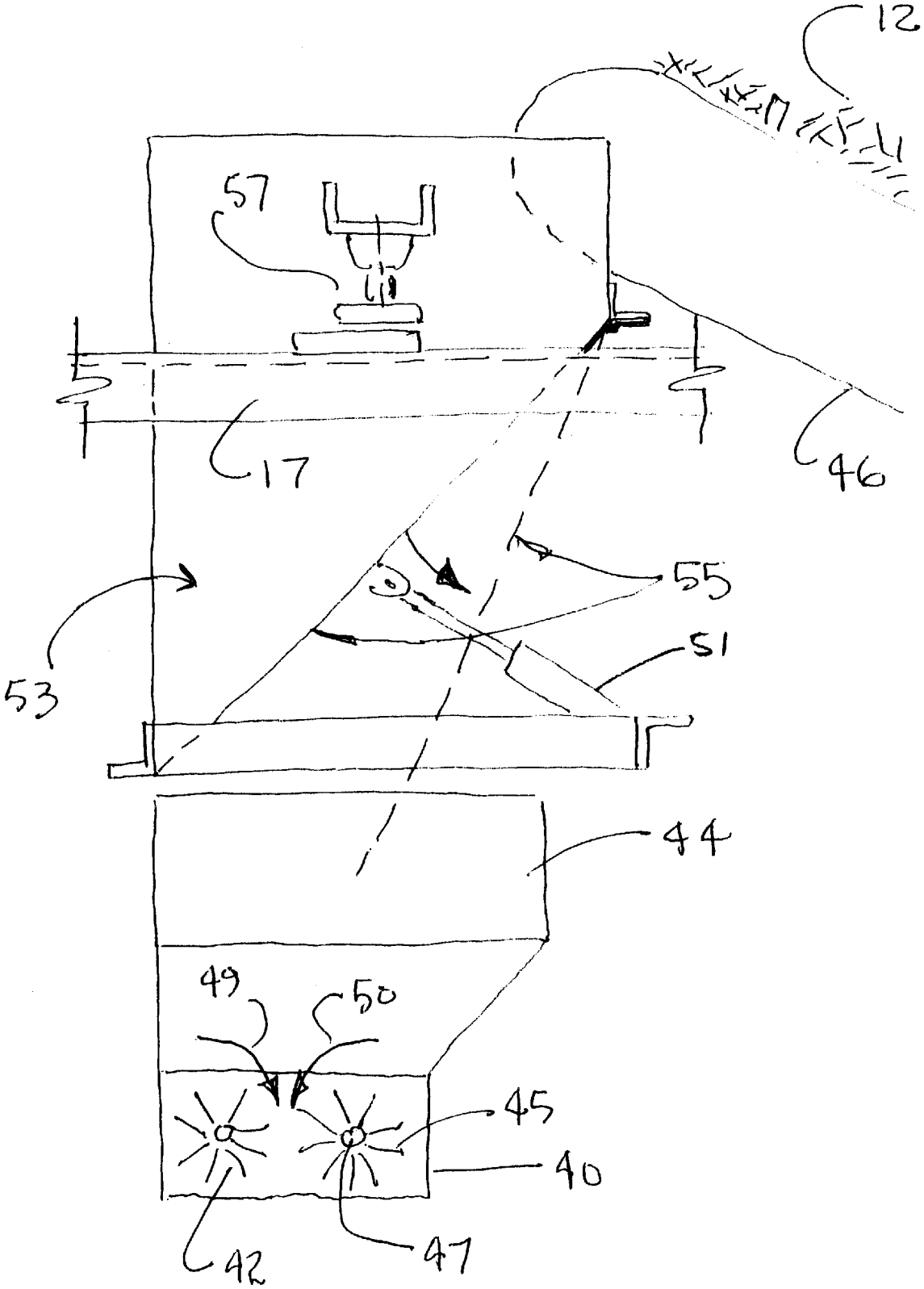
FIG. 5 is a detail view of a portion of FIG. 2.
Figure 6:
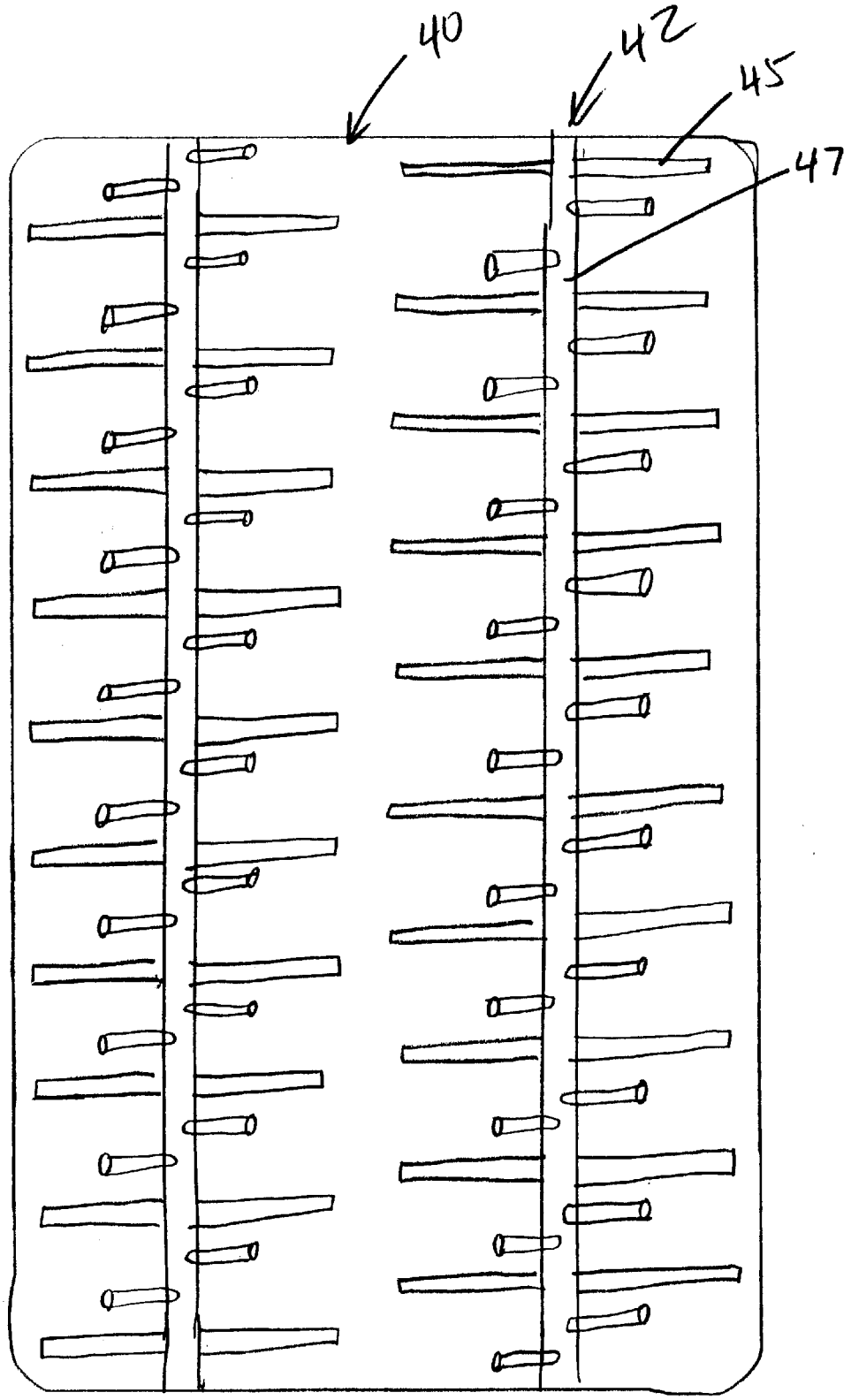
FIG. 6 is a detail view of a portion of FIG. 2.

Referring to FIGS. 5 and 6, at least one distribution bin 40 may be attached to the feed tube 38 for advancing the loose fibers 12 into the fill tube middle section 24. The distribution bin 40 may be made of metal, plastic, wood, ceramic, a composite, or another material known to those skilled in the art. The distribution bin 40 may have at least one rotating pin assembly 42 disposed therein and at least one electric control 43 that controls the rotating pin assembly 42 to advance the loose fibers 12 therethrough at a uniform rate without clogging. Preferably, each bin 40 has two pin assemblies 42 each comprising rows of staggered pins 45 extending from a rotatable shaft 47, the shafts 47 preferably rotating in opposite directions 49 and 50 and operatively coupled to at least one variable speed drive such as the Dayton Right Angle Gearmotor, Model IL4843B made by Dayton Electric Mfg. Co. of Niles, Ill., or another drive known in the art. It should be understood that other means for advancing the fibers 12 through the distribution bin 40 may be suitably employed, for example, oppositely rotating and interposed stars, a vibrating screen, or other mechanisms known to those skilled in the art.

At least one hopper 44 is attached to the distribution bin 42, the hopper 44 having an interior space capable of housing the predetermined volume of loose fibers 12.

The hopper 44 may be made of metal, plastic, wood, ceramic, a composite, or another material known to those skilled in the art.

At least one weight hopper 53 may be positioned above the hopper 44 for weighing and holding a predetermined volume of loose fibers 12 selected for corresponding to a predetermined volume of compacted fibers 12 capable of containment in a particular sized bag 14. The weight hopper has control system for selectively releasing the predetermined volume of fiber 12 into the hopper 44. The control system may be provided by at least one pivotal door 55 operatively coupled to at least one hydraulic or pneumatic cylinder 51 with the door 55 operable by actuation of a foot pedal, lever, pushbutton, or the like, or by another control system known to those skilled in the art. At least one conveyor belt assembly 46 or the like of a type known in the art may be provided generally adjacent to the weight hopper 53 for delivering the loose fibers thereto. Load cells 57 may be associated with the hopper 53 as is known in the art, and the load cells. 57 and the conveyor assembly 46 may be controlled by controllers such as the Model No. WI-130 Weight Indicator and Control System provided by Weigh-Tronix, Inc. of Fairmont, Minn., or by another controller known in the art.

The present invention also comprises a method for packaging the fibers 12 in the bag 14. It should be noted that the method elements may be undertaken in a sequence that varies from the order described herein. The method elements will now be described in detail, with reference to FIGS. 7–12.

Figure 7:
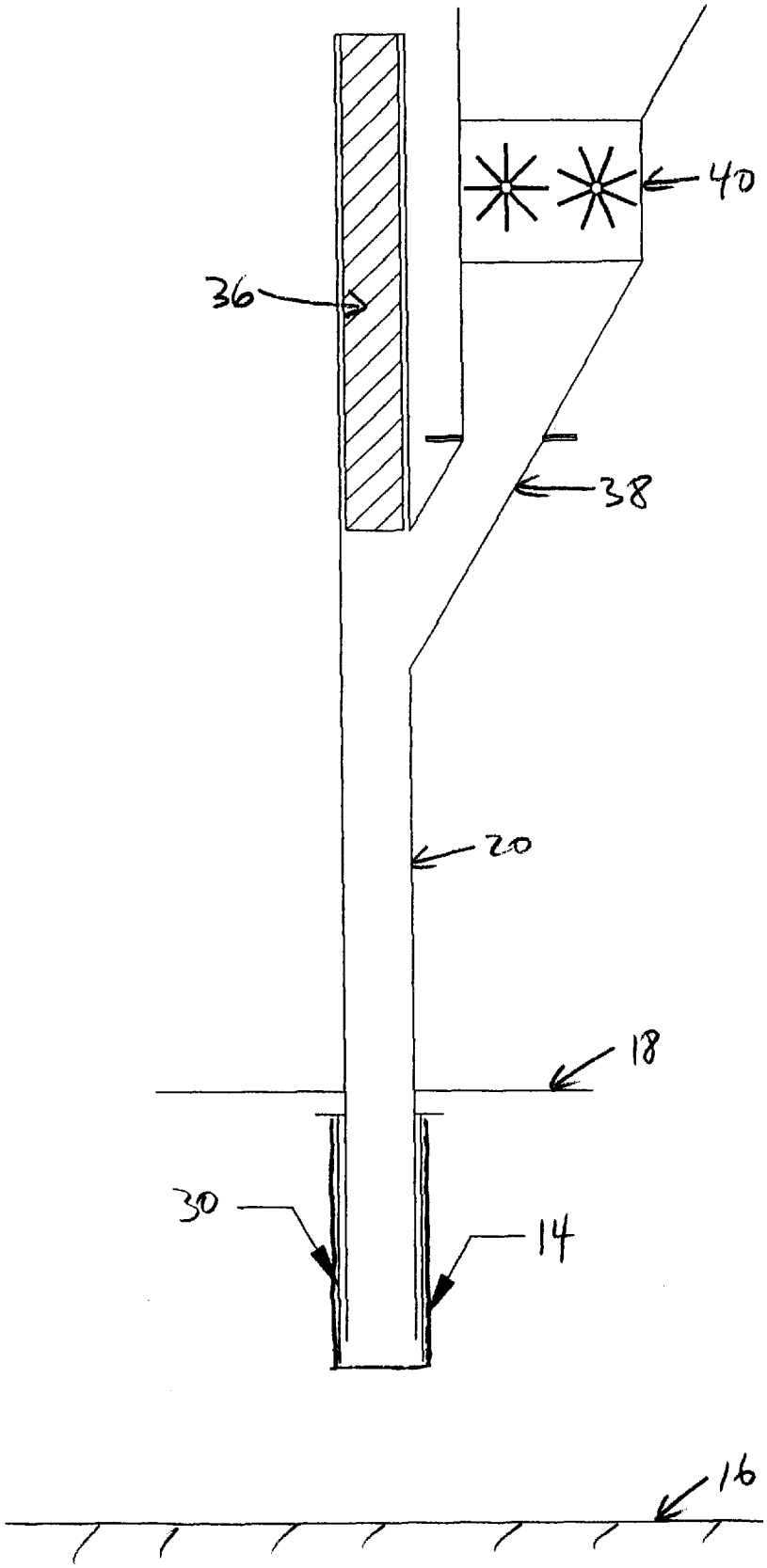
FIG. 7 is an elevation view of the embodiment of FIG. 1 with the bag mounted onto the bag liner tube.
Figure 8:
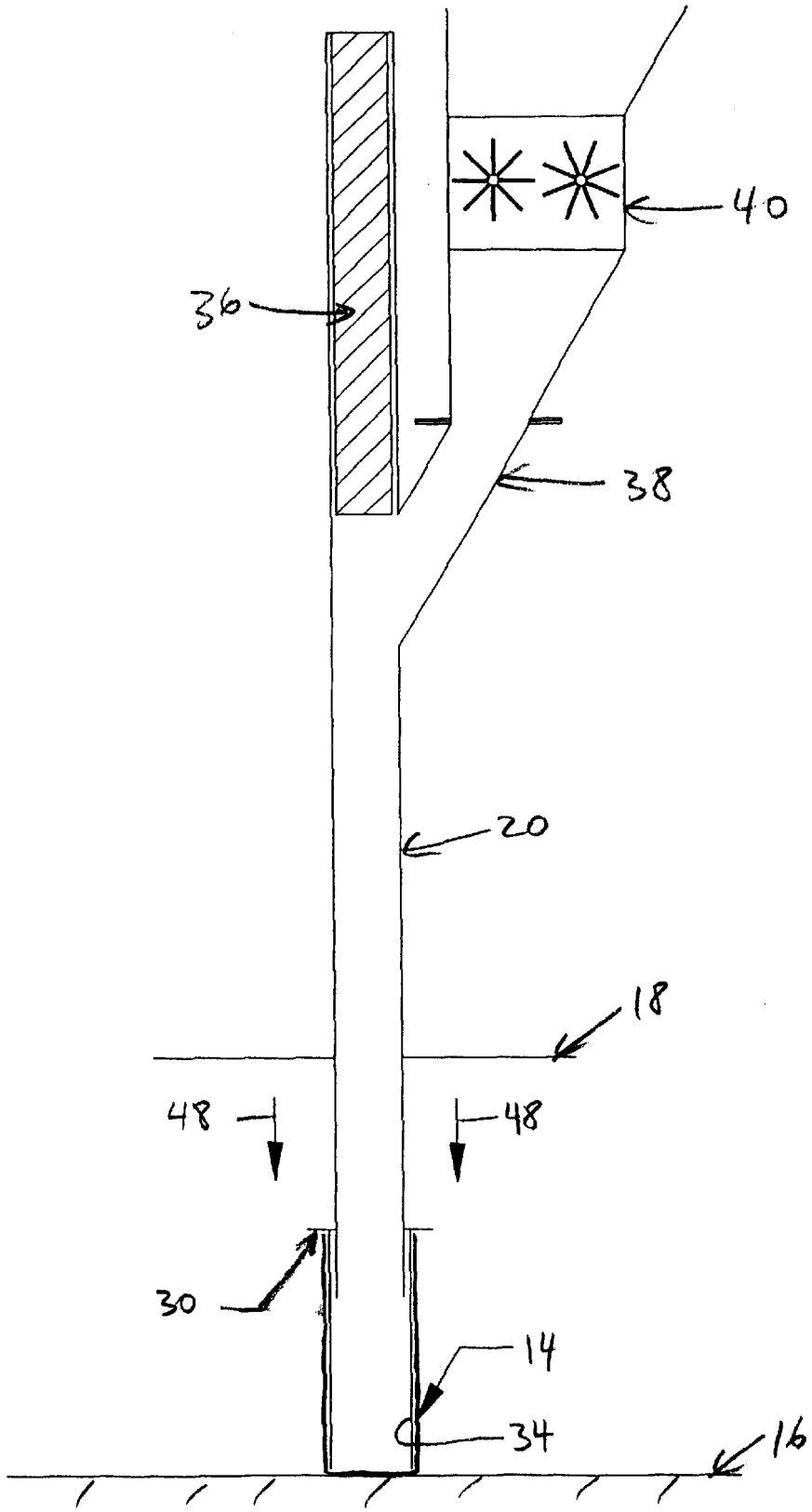
FIG. 8 is an elevation view of the embodiment of FIG. 1 with bag and bag liner tube in the down position.

Referring to FIG. 7, with the ram 36 in the up position within the fill tube upper section 26, and with the bag liner tube 30 is in the up position relative to the lower section 22 of the fill tube 20, the bag 14 is mounted over the bag liner tube 20. Referring to FIG. 8, the bag liner tube 30 is slid 48 to the down position relative to the fill tube lower section 22 such that the fill tube lower section bottom 32 is generally adjacent the base plate 16.

Figure 9:
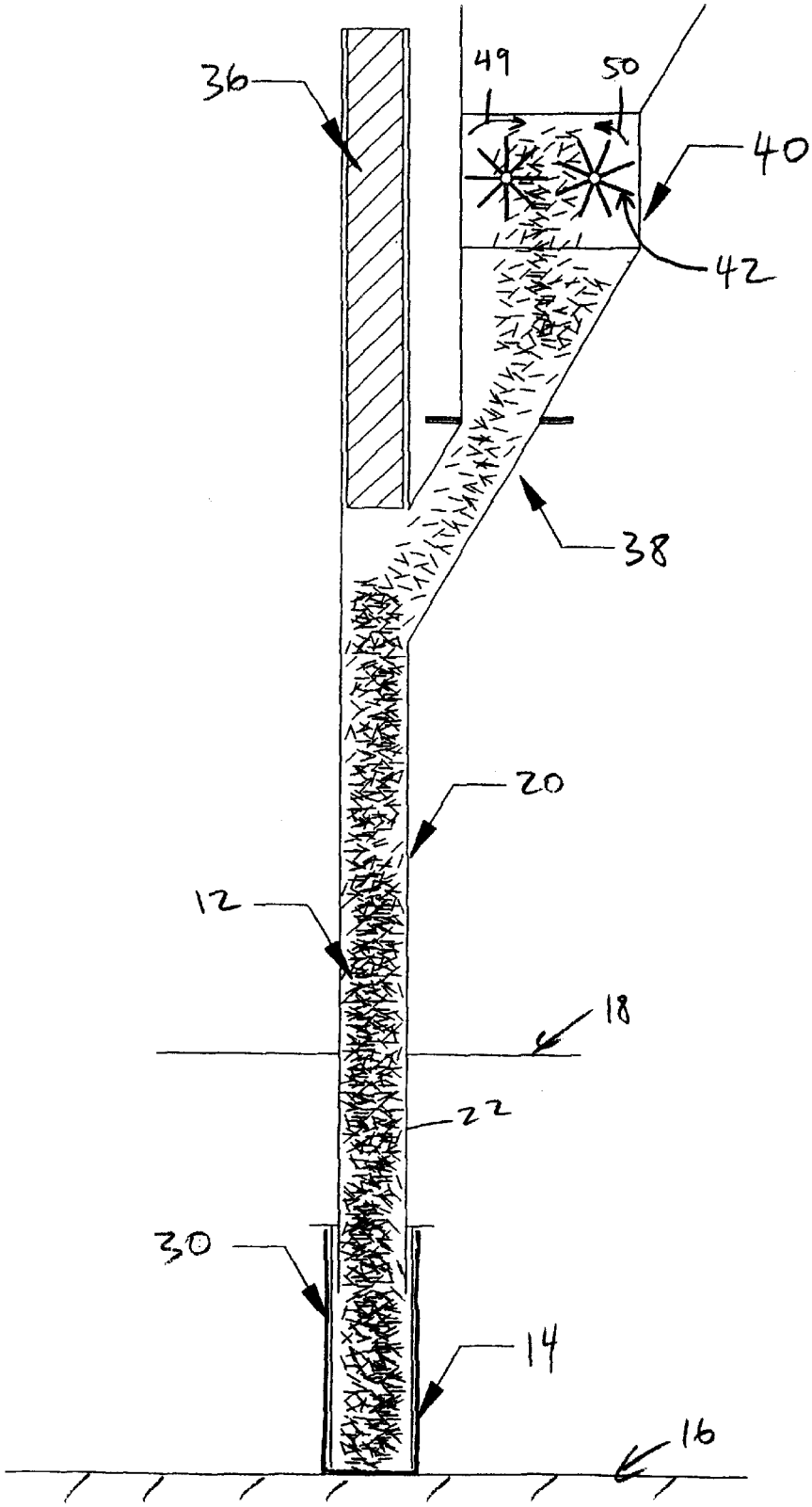
FIG. 9 is an elevation view of the embodiment of FIG. 1 with fibers advanced into the fill tube.
Figure 10:
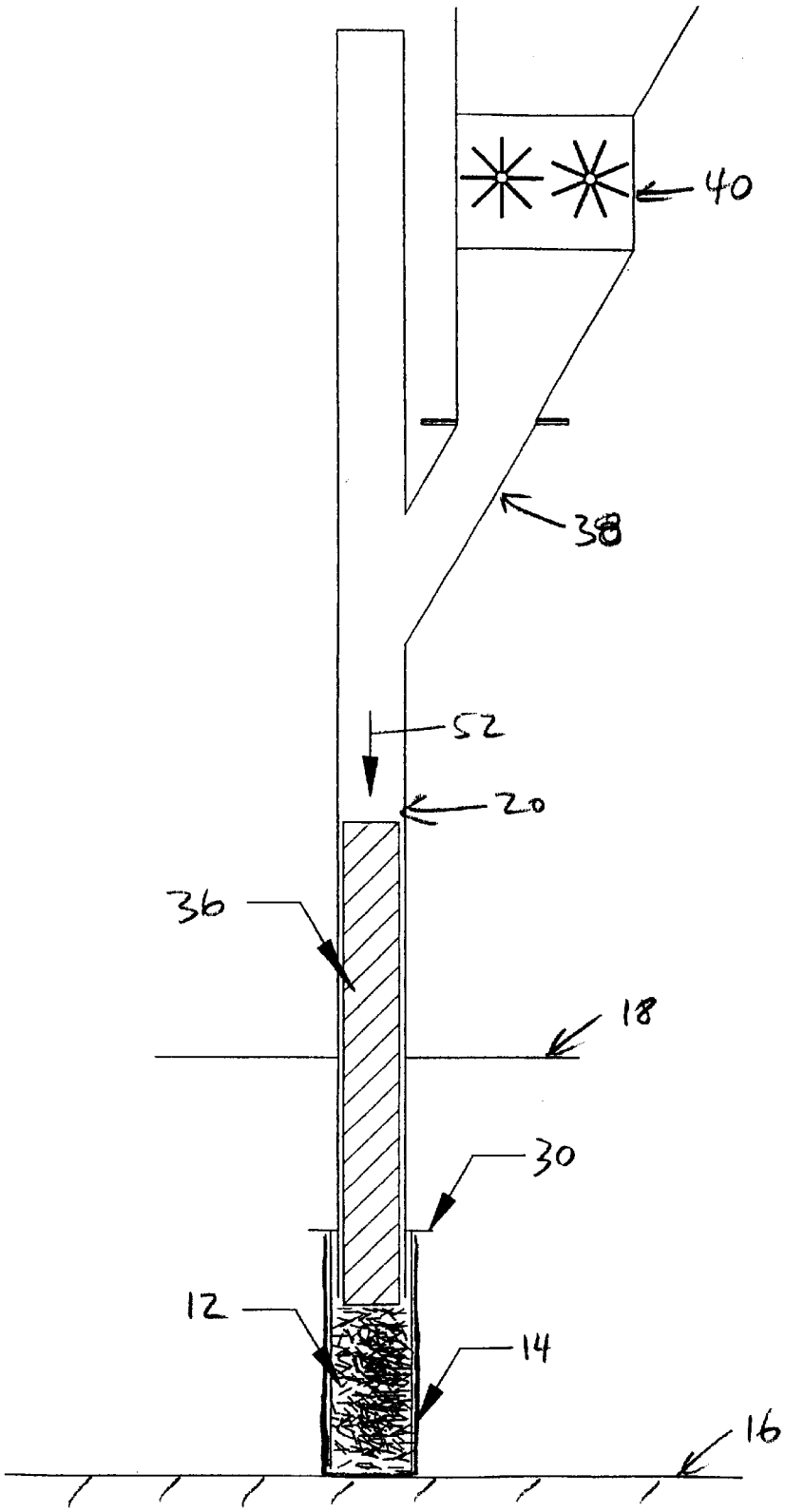
FIG. 10 is an elevation view of the embodiment of FIG. 1 with ram compacting the fibers.

Referring to FIG. 9, the predetermined volume of loose fibers 12 is advanced from the distribution bin 40 through the feed tube 38 into the middle section 24 of the fill tube 20 by rotation 49, 50 of the pins 42 within the distribution bin 40. The fibers 12 may be conveyed into the distribution bin 40 through the hopper 44 and the weight hopper 53 by the conveyor belt 46. Referring to FIG. 10, the ram 36 is slid to the down position within the bag liner tube 30 and bag 14, wherein the loose fibers 12 are compacted into the bag liner tube 30 and bag 14.

Figure 11:
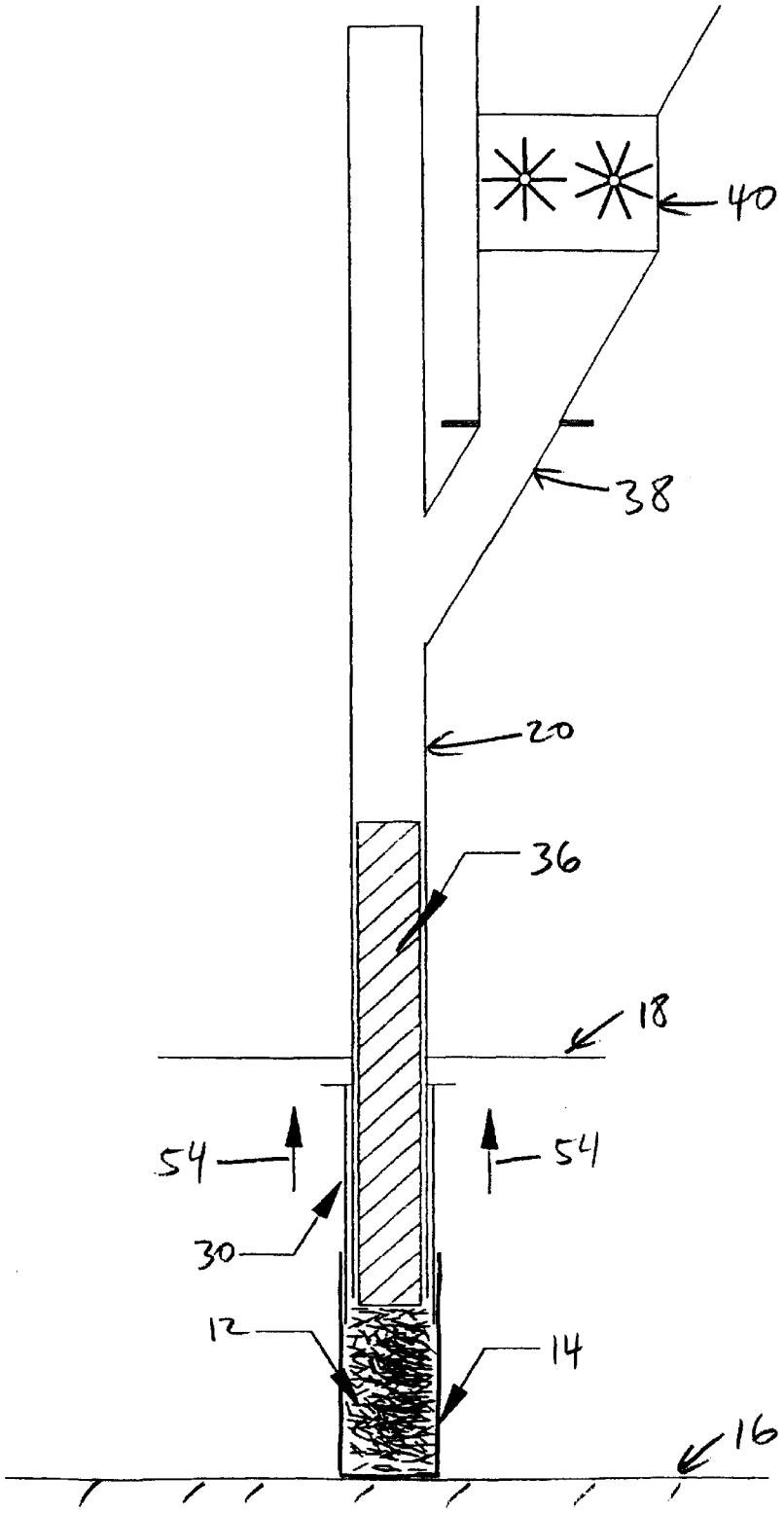
FIG. 11 is an elevation view of the embodiment of FIG. 1 with the bag liner tube being raised.
Figure 12:
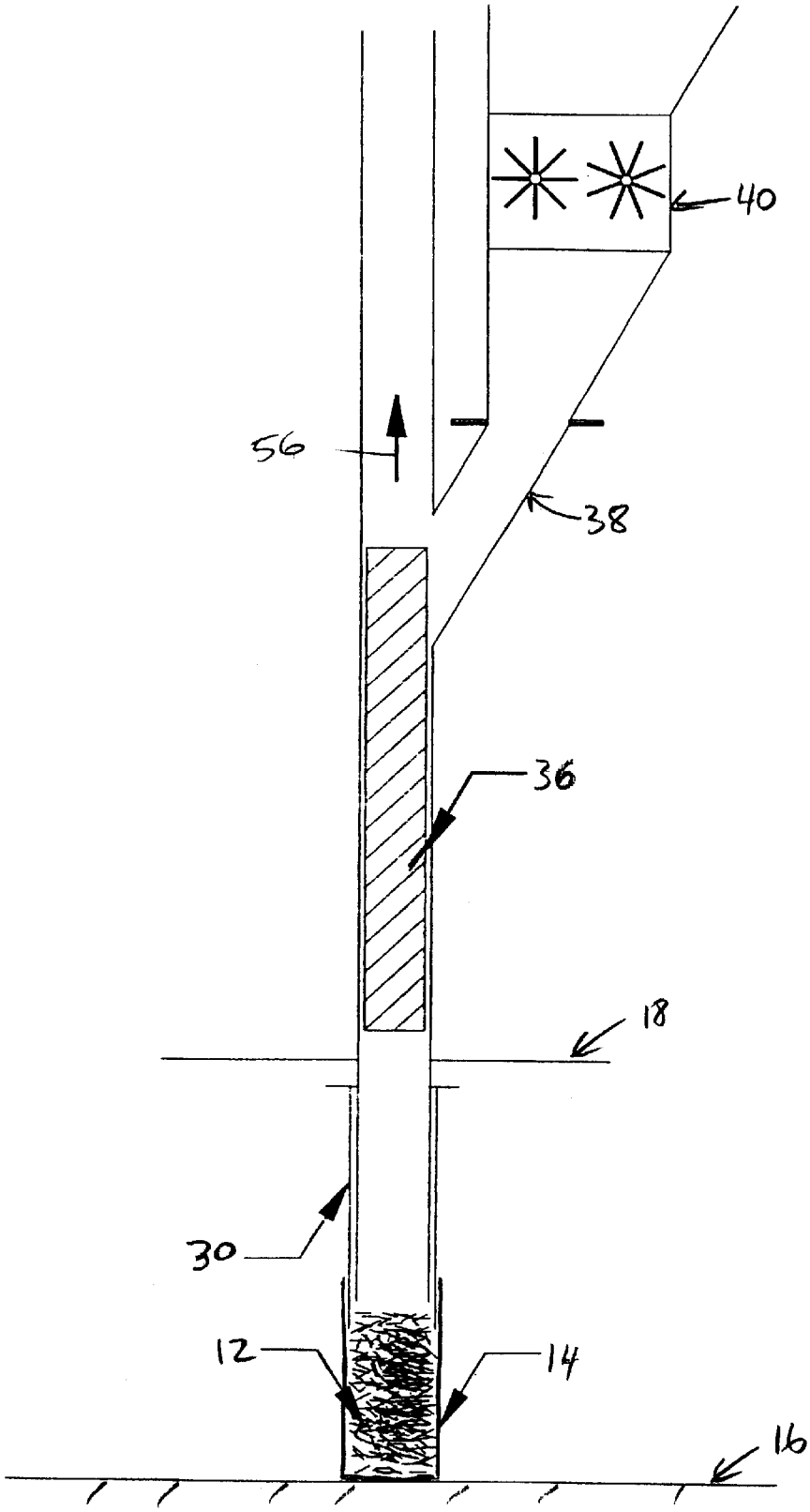
FIG. 12 is an elevation view of the embodiment of FIG. 1 with the ram being raised after compacting the fibers.

Referring to FIG. 11, the bag liner tube 30 is slid 54 to the up position relative to the lower section 22 of the fill tube 20. Referring to FIG. 12, the ram 36 is slid 56 to the up position of FIG. 1, and the bag 14 of compacted fibers 12 is removed from the bag liner 30 and sealed. These acts may be repeated as desired for mass production of bags of compacted fibers. The sealed bag 14 of compacted fibers 12 is added to a concrete matrix in a mixing chamber and agitated by a mixing blade or the like until the bag 14 bursts and the fibers 12 are forced from the bag 14, allowed to return to a loose uncompacted state, and distributed into the concrete matrix.

Figure 13:
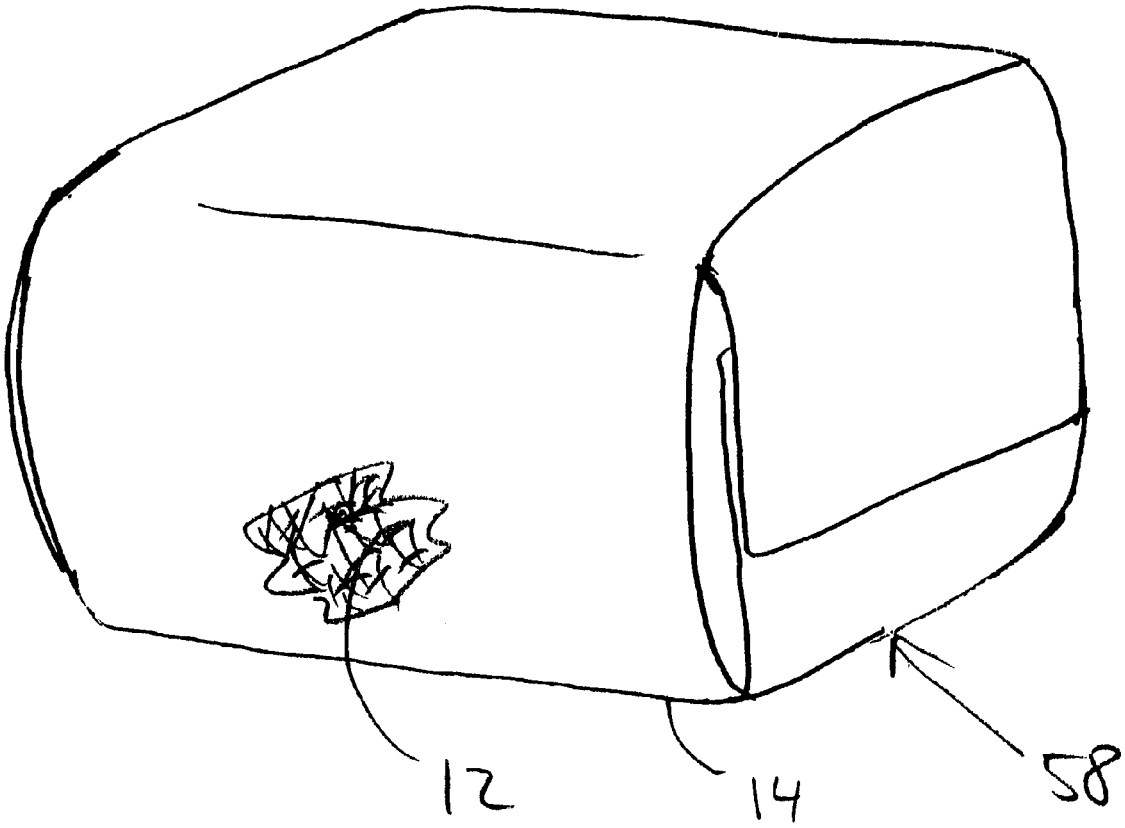
FIG. 13 is a perspective view of one embodiment of the article produced by the method of the present invention.

Referring now to FIG. 13, the present invention also provides an article 58 produced by the method described hereinabove. The article 58 comprises the bag 14 with fiber 12 filled and compacted therein by the method and apparatus 10 described hereinabove. The article 58 may be mixed into a concrete matrix as described herein for reinforcement thereof, or may be mixed into other materials as is known to those skilled in the art.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. Apparatus for packaging fibers in a bag, comprising:

a) at least one base plate;

b) at least one fill tube having a lower section, a middle section, and an upper section, said lower section having a bottom spaced apart from said base plate, said spacing capable of allowing said bag to be disposed generally between said bottom of said lower section and said base plate;

c) at least one bag liner tube slidably coupled to said lower section such that said bag liner tube may slide between an up position and a down position, said up position providing said bag liner spaced apart from said base plate, said spacing capable of allowing said bag to be disposed generally between said bag liner and said base plate, said down position providing said bag liner adjacent to said base plate;

d) at least one ram slidably disposed within said fill tube such that said ram may slide between an up position within said upper section and a down position within said middle and lower sections;

e) at least one feed tube attached to said middle section;

f) at least one distribution bin attached to said feed tube; and g) at least one rotating pin assembly disposed within said distribution bin and at least one electric control that controls said rotating pin assembly, wherein said loose fibers may be advanced through said distribution bin at a uniform rate.

2. The apparatus of claim 1, wherein said rotating pin assembly comprises two shafts capable of rotating in opposite directions, each shaft having rows of staggered pins extending therefrom, each shaft operatively coupled to at least one drive.

3. An apparatus for packaging fibers in a bag, comprising:

a) at least one base plate;

b) at least one fill tube having a lower section, a middle section, and an upper section, said lower section having a bottom spaced apart from said base plate, said spacing capable of allowing said bag to be disposed generally between said bottom of said lower section and said base plate, wherein said middle section, said lower section, and said bag liner tube have lengths such that when said bag liner tube is in said down position said middle section, said lower section, and said bag liner tube are capable of receiving a predetermined volume of loose fibers, and said bag liner tube is capable of housing said fibers after compaction by said ram;

c) at least one bag liner tube slidably coupled to said lower section such that said bag liner tube may slide between an up position and a down position, said up position providing said bag liner spaced apart from said base plate, said spacing capable of allowing said bag to be disposed generally between said bag liner and said base plate, said down position providing said bag liner adjacent to said base plate;

d) at least one ram slidably disposed within said fill tube such that said ram may slide between an up position within said upper section and a down position within said middle and lower sections;

e) at least one feed tube attached to said middle section;

f) at least one distribution bin attached to said feed tube; and, g) at least one weigh hopper associated with said distribution bin and capable of measuring said predetermined volume of loose fibers.

4. The apparatus of claim 3, further comprising a conveyor belt associated with said weigh hopper, wherein said predetermined amount of loose fibers may be advanced into said weigh hopper.

* * * * *